US007419753B2

(12) United States Patent
Vanbesien et al.

(10) Patent No.: US 7,419,753 B2
(45) Date of Patent: Sep. 2, 2008

(54) TONER COMPOSITIONS HAVING RESIN SUBSTANTIALLY FREE OF CROSSLINKING, CROSSLINKED RESIN, POLYESTER RESIN, AND WAX

(75) Inventors: Daryl W. Vanbesien, Burlington (CA); Raj D. Patel, Oakville (CA); Karen A. Moffat, Brantford (CA); Edward G. Zwartz, Mississauga (CA); Cuong Vong, Hamilton (CA)

(73) Assignee: Xerox Corporation, Norwalk, CT (US)

( * ) Notice: Subject to any disclaimer, the term of this patent is extended or adjusted under 35 U.S.C. 154(b) by 379 days.

(21) Appl. No.: 11/275,241

(22) Filed: Dec. 20, 2005

(65) Prior Publication Data

US 2007/0141496 A1 Jun. 21, 2007

(51) Int. Cl.
*G03G 9/087* (2006.01)

(52) U.S. Cl. ..... 430/109.3; 430/109.4; 430/137.11; 430/137.14; 430/123.5; 430/108.4

(58) Field of Classification Search ..... 430/109.4, 430/109.3, 108.4, 108.8, 137.11, 137.14, 430/123.5
See application file for complete search history.

(56) References Cited

U.S. PATENT DOCUMENTS 3,847,604 A 11/1974 Hagenbach et al.
4,291,111 A 9/1981 Lu
4,935,326 A 6/1990 Creatura et al.
4,937,166 A 6/1990 Creatura et al.
5,227,460 A 7/1993 Mahabadi et al.
5,278,020 A 1/1994 Grushkin et al.
5,290,654 A 3/1994 Sacripante et al.
5,308,734 A 5/1994 Sacripante et al.
5,344,738 A 9/1994 Kmiecik-Lawrynowicz et al.
5,346,797 A 9/1994 Kmiecik-Lawrynowicz et al.
5,348,832 A 9/1994 Sacripante et al.
5,352,556 A 10/1994 Mahabadi et al.
5,364,729 A 11/1994 Kmiecik-Lawrynowicz et al.
5,366,841 A 11/1994 Patel et al.
5,370,963 A 12/1994 Patel et al.
5,376,494 A 12/1994 Mahabadi et al.
5,401,602 A 3/1995 Mahabadi et al.
5,403,693 A 4/1995 Patel et al.
5,405,728 A 4/1995 Hopper et al.
5,418,108 A 5/1995 Kmiecik-Lawrynowicz et al.
5,496,676 A 3/1996 Croucher et al.
5,501,935 A 3/1996 Patel et al.
5,527,658 A 6/1996 Hopper et al.
5,585,215 A 12/1996 Ong et al.
5,650,255 A 7/1997 Ng et al.
5,650,256 A 7/1997 Veregin et al.
5,723,253 A 3/1998 Higashino et al.
5,744,520 A 4/1998 Kmiecik-Lawrynowicz et al.
5,747,215 A 5/1998 Ong et al.
5,763,133 A 6/1998 Ong et al.
5,766,818 A 6/1998 Smith et al.
5,804,349 A 9/1998 Ong et al.
5,827,633 A 10/1998 Ong et al.
5,840,462 A 11/1998 Foucher et al.
5,853,944 A 12/1998 Foucher et al.
5,863,698 A 1/1999 Patel et al.
5,869,215 A 2/1999 Ong et al.
5,869,216 A 2/1999 Ong et al.
5,869,558 A 2/1999 Hou
5,902,710 A 5/1999 Ong et al.
5,910,387 A 6/1999 Mychajlowskij et al.
5,916,725 A 6/1999 Patel et al.
5,919,595 A 7/1999 Mychajlowskij et al.
5,922,501 A 7/1999 Cheng et al.
5,925,488 A 7/1999 Patel et al.
5,928,830 A 7/1999 Cheng et al.
5,945,245 A 8/1999 Mychajlowskij et al.
5,977,210 A 11/1999 Patel et al.
5,994,020 A 11/1999 Patel et al.
6,130,021 A 10/2000 Patel et al.
6,132,924 A 10/2000 Patel et al.
6,140,003 A * 10/2000 Sacripante et al. ..... 430/108.4
6,210,853 B1 4/2001 Patel et al.
6,268,102 B1 7/2001 Hopper et al.
6,294,306 B1 9/2001 Kmiecik-Lawrynowicz et al.
6,309,787 B1 10/2001 Cheng
6,395,442 B1 5/2002 Hayashi et al.
6,413,692 B1 7/2002 Cheng
6,416,920 B1 7/2002 Hopper et al.
6,447,974 B1 9/2002 Chen et al.
6,472,117 B1 10/2002 Kohyama et al.
6,475,688 B1 * 11/2002 Tamura et al. ..... 430/108.4
6,495,302 B1 12/2002 Jiang et al.
6,500,597 B1 12/2002 Patel et al.
6,541,175 B1 4/2003 Jiang et al.
6,576,389 B2 6/2003 Vanbesien et al.
6,602,644 B2 8/2003 Matsushima et al.
6,617,091 B2 9/2003 Nishimori et al.
6,617,092 B1 9/2003 Patel et al.
6,627,373 B1 9/2003 Patel et al.
6,638,677 B2 10/2003 Patel et al.
6,656,657 B2 12/2003 Patel et al.
6,656,658 B2 12/2003 Patel et al.
6,664,017 B1 12/2003 Patel et al.

(Continued)

*Primary Examiner*—Christopher RoDee
(74) *Attorney, Agent, or Firm*—Oliff & Berridge, PLC

(57) ABSTRACT

A toner composition that includes a resin substantially free of cross linking, a cross linked resin, a polyester resin as a crystalline polyester resin, and a colorant.

24 Claims, 3 Drawing Sheets

U.S. PATENT DOCUMENTS

| | | | | |
|---|---|---|---|---|
| 6,673,505 | B2 | 1/2004 | Jiang et al. | |
| 6,677,097 | B2 | 1/2004 | Ohmura et al. | |
| 6,743,559 | B2 | 6/2004 | Combes et al. | |
| 6,756,176 | B2 | 6/2004 | Stegamat et al. | |
| 6,808,851 | B2 * | 10/2004 | Bartel et al. | 430/108.1 |
| 6,830,860 | B2 * | 12/2004 | Sacripante et al. | 430/109.3 |
| 6,942,954 | B2 * | 9/2005 | Patel et al. | 523/335 |
| 7,300,734 | B2 | 11/2007 | McDougall et al. | |
| 7,358,021 | B2 | 4/2008 | Patel et al. | |
| 2004/0265727 | A1 | 12/2004 | Vanbesien et al. | |
| 2005/0255402 | A1 | 11/2005 | Hopper et al. | |
| 2006/0063086 | A1 | 3/2006 | Sacripante et al. | |
| 2006/0121380 | A1 | 6/2006 | Skorokhod et al. | |
| 2006/0121383 | A1 | 6/2006 | Zwartz et al. | |
| 2006/0121387 | A1 | 6/2006 | Zwartz et al. | |

* cited by examiner

TONER COMPOSITIONS HAVING RESIN SUBSTANTIALLY FREE OF CROSSLINKING, CROSSLINKED RESIN, POLYESTER RESIN, AND WAX

TECHNICAL FIELD

This disclosure is generally directed to toner processes, and more specifically, emulsion aggregation and coalescence processes, as well as toner compositions formed by such processes. More specifically, this disclosure is directed to methods for the preparation of toner compositions by a chemical process, such as emulsion aggregation, wherein non-crosslinked latex particles, such as latexes containing non-crosslinked vinyl polymeric particles, are aggregated with a polyester, such as a crystalline polyester, crosslinked latex particles, such as latexes containing crosslinked vinyl polymeric particles, a wax and colorants, in the presence of a coagulant like a polymetal halide.

RELATED APPLICATIONS

Illustrated in copending application U.S. Ser. No. 11/003,581, filed Dec. 3, 2004, entitled Toner Compositions, is a toner composition comprising: a resin substantially free of cross linking; a cross linked resin; a wax; and a colorant. For example, the application illustrates a toner process comprising: mixing a resin substantially free of cross linking and a cross linked resin in the presence of a wax, a colorant, and a coagulant to provide toner size aggregates; adding additional resin substantially free of cross linking to the formed aggregates thereby providing a shell over the formed aggregates; heating the shell covered aggregates to form toner; and optionally, isolating the toner.

Illustrated in copending application U.S. Ser. No. 11/044,847, filed Jan. 27, 2005, entitled Hybrid Toner Processes, is a toner process comprised of a first heating of a colorant dispersion, a first latex emulsion, a second latex emulsion, and a wax dispersion in the presence of a coagulant containing a metal ion; adding a third latex; adding an organic sequestering compound or a silicate salt sequestering compound, followed by a second heating wherein the first heating is accomplished at below about the first latex polymer glass transition temperature, and the second heating is above about the first latex polymer glass transition temperature, and wherein the first latex and the third latex are free of a polyester, and the second latex contains a polyester.

Illustrated in copending application U.S. Ser. No. 10/948,450, filed Sep. 23, 2004, entitled Low Melt Toners and Processes Thereof, is a process for preparing a low-melt toner, the process comprising: forming a pre-toner mixture comprising a first alkali sulfonated polyester resin, a second alkali sulfonated polyester resin and a colorant; adding an aggregating agent to the pre-toner mixture and aggregating the mixture to form an aggregate mix comprising a plurality of aggregate toner particles; coalescing the aggregate mix at a temperature of from about 5 to about 20° C. above the glass transition temperature ($T_g$) of one of the first or second alkali sulfonated polyester resins to form a mixture of coalesced toner particles; and cooling the mixture of coalesced toner particles.

Illustrated in copending application U.S. Ser. No. 10/606,330, filed Jun. 25, 2003, entitled Toner Processes, is a toner process comprised of heating a mixture of an acicular magnetite dispersion, a colorant dispersion, a wax dispersion, a first latex containing a crosslinked resin, and a second latex containing a resin free of crosslinking in the presence of a coagulant to provide aggregates, stabilizing the aggregates with a silicate salt dissolved in a base, and further heating the aggregates to provide coalesced toner particles.

Illustrated in copending application U.S. Ser. No. 10/606,298, filed Jun. 25, 2003, entitled Toner Processes, is a toner process comprised of a first heating of a mixture of an aqueous colorant dispersion, an aqueous latex emulsion, and an aqueous wax dispersion in the presence of a coagulant to provide aggregates, adding a base followed by adding an organic sequestering agent, and thereafter accomplishing a second heating, and wherein the first heating is below about the latex polymer glass transition temperature (Tg), and the second heating is about above the latex polymer glass transition temperature.

Illustrated in copending application U.S. Ser. No. 10/603,449, filed Jun. 25, 2003, entitled Toner Processes, is a toner process comprised of a first heating of a colorant dispersion, a latex emulsion, and a wax dispersion in the presence of a coagulant containing a metal ion; adding a silicate salt; followed by a second heating.

Illustrated in U.S. Pat. No. 6,576,389, filed Oct. 15, 2001 on Toner Coagulant Processes, is a process for the preparation of toner comprising mixing a colorant dispersion, a latex emulsion, a wax dispersion and coagulants comprising a colloidal alumina coated silica, and a polymetal halide.

The appropriate components, such as for example, waxes, coagulants, resin latexes, surfactants, and colorants, and processes of the above copending applications and patents may be selected for the present disclosure in embodiments thereof. The entire disclosures of the above-mentioned applications are totally incorporated herein by reference.

BACKGROUND

Illustrated herein in embodiments are toner processes, and more specifically, emulsion aggregation and coalescence processes. More specifically, disclosed in embodiments are methods for the preparation of toner compositions by a chemical process, such as emulsion aggregation, wherein non-crosslinked latex particles, such as latexes containing non-crosslinked vinyl polymeric particles, are aggregated with a polyester, such as a crystalline polyester (CPE), crosslinked latex particles, such as latexes containing crosslinked vinyl polymeric particles, a wax and colorants, in the presence of a coagulant like a polymetal halide, optionally adding a latex containing further vinyl polymeric particles, thereafter stabilizing the aggregates and coalescing or fusing the aggregates by heating the mixture above the resin Tg to provide toner size particles.

A number of advantages are associated with the toner obtained by the processes illustrated herein. For example, the processes provide toner particles having a suitable toner minimum fixing temperature (MFT) lower than many conventional toner compositions. A lower MFT is desirable, for example, because it results in lower fuser roll temperature, reduced energy consumption and warm up time, and reduces the stress on the fuser roll. In embodiments, the MFT can be as much as 20° C. or more below conventional toner compositions, thus having a MFT below about 200° C., such as from about 130° C. to about 180° C. The processes also provide toner particles having both a crystalline polyester resin and a gel resin content. In combination, the polyester resin upon fusing plasticizes the toner particles resulting to provide the reduced MFT, while the gel latex provides low gloss suitable for monochrome, particularly black, toner applications (such as a gloss value of 12 Gardner Gloss Units (ggu) or less).

REFERENCES

In U.S. Pat. No. 6,677,097, there is illustrated a toner for developing a static image comprising at least a resin, colorant and crystalline substance. The toner particle has a domain-matrix structure and the domain has an average of the ratio of the major axis to the minor axis of from 1.5 to 2.5 when the domain is approximated by an ellipse.

In U.S. Pat. No. 6,602,644, there is illustrated a toner for developing an electrostatic latent image. The toner comprises a resin, a colorant and a releasing agent or a crystalline polyester compound, and the toner has crushability index from 0.1 to 0.8. The toner is preferably produced by sat-out/fusion-adherence of a composite resin particle and a colorant particle, the composite resin particle comprises polyester compound in a portion of the composite resin particle other than outermost layer.

In U.S. Pat. No. 6,617,091, there is illustrated a method of preparing toner for developing an electrostatic image. The method comprises process for adhering by fusing resin particles onto surface of colored particles (core particles) containing a resin particle and a colorant by salting-out/fusion-adhering to form the resin layer (shell).

In U.S. Pat. No. 6,472,117, there is illustrated a toner for developing an electrostatic image comprising a resin, a colorant and a releasing agent in which the toner particles are obtained by salting out/fusion-adhering a resin particle comprising a binding resin and a releasing agent together with a colorant particle. The toner comprises the toner particles having a variation coefficient of the number particle size distribution of not more than 27 percent.

In U.S. Pat. No. 6,395,442, there is illustrated a toner for electrophotography. The resin binder is obtained by fusing fine resin particles comprising a crystalline material and amorphous polymer in a water-based medium. The crystalline material preferably has a melting point of 60 to 130° C., a number average molecular weight of 1,500 to 15,000, and a melt viscosity at the melting point +20° C. of not more than 100 Pa·s, and the amorphous polymer is preferably composed of a radically polymerizable monomer.

In U.S. Pat. No. 6,268,102, there is illustrated a process for the preparation of toner comprising mixing a colorant a latex, and a coagulant, followed by aggregation and coalescence, wherein the coagulant may be a polyaluminum sulfosilicate.

In U.S. Pat. No. 6,132,924, there is illustrated a process for the preparation of toner comprising mixing a colorant, a latex, and two coagulants, followed by aggregation and coalescence, and wherein one of the coagulants may be polyaluminum chloride.

Illustrated in U.S. Pat. No. 5,994,020, are toner preparation processes, and more specifically, a process for the preparation of toner comprising:

(i) preparing, or providing a colorant dispersion;

(ii) preparing, or providing a functionalized wax dispersion comprised of a functionalized wax contained in a dispersant mixture comprised of a nonionic surfactant, an ionic surfactant, or mixtures thereof;

(iii) shearing the resulting mixture of the functionalized wax dispersion (ii) and the colorant dispersion (i) with a latex or emulsion blend comprised of resin contained in a mixture of an anionic surfactant and a nonionic surfactant;

(iv) heating the resulting sheared blend of (iii) below about the glass transition temperature (Tg) of the resin particles;

(v) optionally adding additional anionic surfactant to the resulting aggregated suspension of (iv) to prevent, or minimize additional particle growth of the resulting electrostatically bound toner size aggregates during coalescence (iv);

(vi) heating the resulting mixture of (v) above about the Tg of the resin; and optionally, (vii) separating the toner particles; and a process for the preparation of toner comprising blending a latex emulsion containing resin, colorant, and a polymeric additive; adding an acid to achieve a pH of about 2 to about 4 for the resulting mixture; heating at a temperature about equal to, or about below the glass transition temperature (Tg) of the latex resin; optionally adding an ionic surfactant stabilizer; heating at a temperature about equal to, or about above about the Tg of the latex resin; and optionally cooling, isolating, washing, and drying the toner.

Illustrated in U.S. Pat. No. 6,541,175, is a process comprising:

(i) providing or generating an emulsion latex comprised of sodio sulfonated polyester resin particles by heating the particles in water at a temperature of from about 65° C. to about 90° C.;

(ii) adding with shearing to the latex (i) a colorant dispersion comprising from about 20 percent to about 50 percent of a predispersed colorant in water, followed by the addition of an organic or an inorganic acid;

(iii) heating the resulting mixture at a temperature of from about 45° C. to about 65° C. followed by the addition of a water insoluble metal salt or a water insoluble metal oxide thereby releasing metal ions and permitting aggregation and coalescence, optionally resulting in toner particles of from about 2 to about 25 microns in volume average diameter; and optionally (iv) cooling the mixture and isolating the product.

Also of interest is U.S. Pat. No. 6,416,920, which illustrates a process for the preparation of toner comprising mixing a colorant, a latex, and a silica, which silica is coated with an alumina.

Illustrated in U.S. Pat. No. 6,495,302, is a process for the preparation of toner comprising (i) generating a latex emulsion of resin, water, and an ionic surfactant, and a colorant dispersion of a pigment, water, an ionic surfactant, or a nonionic surfactant, and wherein (ii) the latex emulsion is blended with the colorant dispersion;

(iii) adding to the resulting blend containing the latex and colorant a coagulant of a polyaluminum chloride with an opposite charge to that of the ionic surfactant latex colorant;

(iv) heating the resulting mixture below or equal to about the glass transition temperature (Tg) of the latex resin to form aggregates;

(v) optionally adding a second latex comprised of submicron resin particles suspended in an aqueous phase (iv) resulting in a shell or coating wherein the shell is optionally of from about 0.1 to about 1 micron in thickness, and wherein optionally the shell coating is contained on 100 percent of the aggregates;

(vi) adding an organic water soluble or water insoluble chelating component to the aggregates of (v) particles, followed by adding a base to change the resulting toner aggregate mixture from a pH which is initially from about 1.9 to about 3 to a pH of about 5 to about 9;

(vii) heating the resulting aggregate suspension of (vi) above about the Tg of the latex resin;

(viii) optionally retaining the mixture (vii) at a temperature of from about 70° C. to about 95° C.;

(ix) changing the pH of the (viii) mixture by the addition of an acid to arrive at a pH of about 1.7 to about 4; and (x) optionally isolating the toner.

Illustrated in U.S. Pat. No. 6,500,597, is a process comprising (i) blending a colorant dispersion of a pigment, water, and an anionic surfactant, or a nonionic surfactant with (ii) a latex emulsion comprised of resin, water, and an ionic surfactant;

(iii) adding to the resulting blend a first coagulant of polyaluminum sulfosilicate (PASS) and a second cationic co-coagulant having an opposite charge polarity to that of the latex surfactant;

(iv) heating the resulting mixture below about the glass transition temperature (Tg) of the latex resin;

(v) adjusting with a base the pH of the resulting toner aggregate mixture from a pH which is in the range of about 1.8 to about 3 to a pH range of about 5 to about 9;

(vi) heating above about the Tg of the latex resin;

(vii) changing the pH of the mixture by the addition of a metal salt to arrive at a pH of from about 2.8 to about 5; and (viii) optionally isolating the product.

Emulsion/aggregation/coalescing processes for the preparation of toners are illustrated in a number of Xerox patents, such as U.S. Pat. Nos. 5,290,654, 5,278,020, 5,308,734, 5,370,963, 5,344,738, 5,403,693, 5,418,108, 5,364,729, and 5,346,797; and also of interest maybe U.S. Pat. Nos. 5,348,832; 5,405,728; 5,366,841; 5,496,676; 5,527,658; 5,585,215; 5,650,255; 5,650,256 5,501,935; 5,723,253; 5,744,520; 5,763,133; 5,766,818; 5,747,215; 5,827,633; 5,853,944; 5,804,349; 5,840,462; 5,869,215; 5,869,215; 5,863,698; 5,902,710; 5,910,387; 5,916,725; 5,919,595; 5,925,488 and 5,977,210.

In addition, the following U.S. Patents relate to emulsion aggregation toner processes.

U.S. Pat. No. 5,922,501, illustrates a process for the preparation of toner comprising blending an aqueous colorant dispersion and a latex resin emulsion, and which latex resin is generated from a dimeric acrylic acid, an oligomer acrylic acid, or mixtures thereof and a monomer; heating the resulting mixture at a temperature about equal, or below about the glass transition temperature (Tg) of the latex resin to form aggregates; heating the resulting aggregates at a temperature about equal to, or above about the Tg of the latex resin to effect coalescence and fusing of the aggregates; and optionally isolating the toner product, washing, and drying.

U.S. Pat. No. 5,945,245, illustrates a surfactant free process for the preparation of toner comprising heating a mixture of an emulsion latex, a colorant, and an organic complexing agent.

The disclosures of each of the foregoing patents and publications are hereby incorporated by reference herein in their entireties. The appropriate components and process aspects of the each of the foregoing patents and publications may also be selected for the present compositions and processes in embodiments thereof.

SUMMARY

A toner composition and a process for preparing a toner including, for example, an emulsion aggregation process for preparing a toner, are described. The toner composition comprises, for example, a resin substantially free of cross linking; a cross linked resin; a polyester resin such as a crystalline polyester resin, a wax; and a colorant. For example, a resin that is substantially free of cross linking (also referred to as a non-crosslinked resin) comprises a resin having substantially about zero percent cross linking to about 0.1 percent cross linking. For example, a cross linked resin comprises a cross linked resin or gel comprising, for example, having a degree of cross linking from about 0.3 percent to about 30 percent or to about 50 percent, such as about 0.3 or about 0.5 to about 20 percent.

A process for preparing a toner comprises, for example, mixing a resin substantially free of cross linking, a cross-linked resin, and a polyester resin such as a crystalline polyester resin in the presence of a wax, a colorant, and a coagulant to provide toner size aggregates; optionally adding additional resin substantially free of cross linking or cross linked resin to the formed aggregates thereby providing a shell, having a thickness of for example about 0.1 to about 2 or about 5 microns, such as about 0.3 to about 0.8 micrometers, over the formed aggregates; heating the optionally shell covered aggregates to form toner; and, optionally, isolating the toner. In embodiments, the heating comprises a first heating below the glass transition temperature of the resin substantially free of cross linking and a second heating above the glass transition temperature of the resin substantially free of cross linking. In embodiments, the toner process provides a shell having a thickness of for example about 0.1 to about 2 or about 5 microns, such as about 0.3 to about 0.8 micrometers.

The toners generated with the present processes are especially useful for imaging processes, especially xerographic processes. The toners advantageously provide characteristics that meet reprographic machine requirements such as minimum fixing temperature such as less than 200° C. such as from about 130° C. to about 180° C., wide fusing latitude, good release, low gloss such as less than about 12 Gardner Gloss Units (ggu), robust particles, and triboelectrical properties.

In an embodiment, the present disclosure provides a toner composition comprising:

a resin substantially free of cross linking;

a cross linked resin;

a polyester resin; and a colorant.

In another embodiment, the present disclosure provides a toner process comprising:

mixing a resin substantially free of cross linking, a cross linked resin, a polyester resin, a wax, a colorant, and a coagulant to provide toner size aggregates;

adding additional resin substantially free of cross linking to the formed aggregates thereby providing a shell over the formed aggregates;

heating the aggregates to form toner; and optionally, isolating the toner.

EMBODIMENTS

Figure 1:
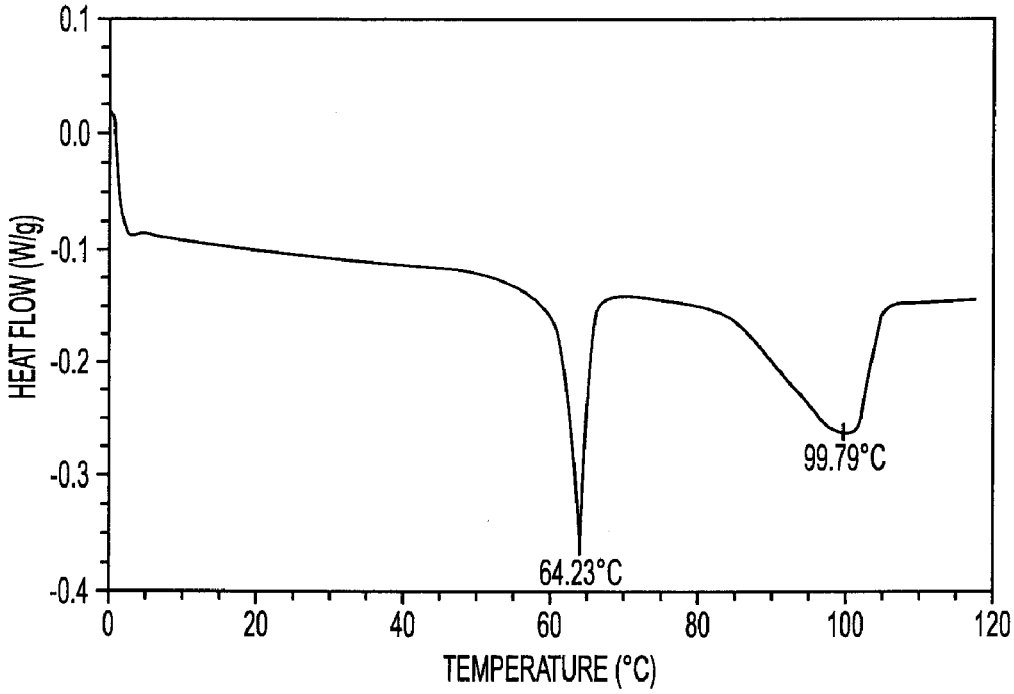
FIG. 1 shows the DSC scan of a toner according to an embodiment of this disclosure.

Toner compositions will now be described comprising a non cross linked resin; a cross linked resin or gel; a polyester resin such as a crystalline polyester resin; and a colorant; and a process for preparing a toner comprising mixing a non cross linked resin, a cross linked resin, and a polyester resin such as a crystalline polyester resin in the presence of a wax, a colorant, and a coagulant to provide toner size aggregates; optionally adding additional cross linked or non-cross linked latex to the formed aggregates thereby providing a shell over the formed aggregates; heating the optionally shell covered aggregates to form toner; and, optionally, isolating the toner. In embodiments, the toner process includes providing an anionic surfactant in an amount of for example about 0.01% to about 20% by weight based upon a total weight of the reaction mixture; wherein for example the anionic surfactant is selected from the group consisting of sodium dodecylsulfate, sodium dodecylbenzene sulfonate, sodium dodecylnaphthalene sulfate, dialkyl benzenealkyl, sulfates, sulfonates, adipic acid, hexa decyldiphenyloxide disulfonate, or mixtures thereof. In further embodiments, the optional shell thus formed has, for example, a thickness of about 0.3 to about 0.8 micrometers.

Illustrative examples of latex resins or polymers selected for the non cross linked resin and cross linked resin or gel include styrene acrylates, styrene methacrylates, butadienes, isoprene, acrylonitrile, acrylic acid, methacrylic acid, beta-carboxy ethyl arylate, polyesters, known polymers such as poly(styrene-butadiene), poly(methyl styrene-butadiene), poly(methyl methacrylate-butadiene), poly(ethyl methacrylate-butadiene), poly(propyl methacrylate-butadiene), poly (butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methyl styrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly (styrene-butyl acrylate), poly(styrene-butadiene-acrylic acid), poly(styrene-butadiene-methacrylic acid), poly(styrene-butyl acrylate-acrylic acid), poly(styrene-butyl acrylate-methacrylic acid), poly(styrene-butyl acrylate-acrylonitrile), poly(styrene-butyl acrylate-acrylonitrile-acrylic acid), and the like. In embodiments, the resin or polymer is a styrene/butyl acrylate/carboxylic acid terpolymer. In embodiments, at least one of the resin substantially free of cross linking and the cross linked resin comprises carboxylic acid in an amount of about 0.05 to about 10 weight percent based upon the total weight of the resin substantially free of cross linking or cross linked resin.

In embodiments, the non cross linked resin (or resin substantially free of cross linking) does not include or is substantially free of a polyester resin, such as a crystalline polyester resin. In other embodiments, the cross linked resin excludes a polyester resin, such as a crystalline polyester resin. In still other embodiments, both the non cross linked resin (or resin substantially free of cross linking) and the cross linked resin can be free of a polyester resin, such as a crystalline polyester resin. Instead, in these embodiments, a polyester resin, such as a crystalline polyester resin, is added in the form of a third resin latex. The term "substantially free of a polyester resin" refers, for example, to having less than about 1% by weight polyester in the particular resin latex, such as less than about 0.5% or less than about 0.1% by weight polyester in the particular resin latex.

In embodiments, the resin that is substantially free of cross linking (also referred to herein as a non cross linked resin) comprises a resin having less than about 0.1 percent cross linking. For example, the non cross linked latex comprises in embodiments styrene, butylacrylate, and beta-carboxy ethyl acrylate (beta-CEA) monomers, although not limited to these monomers, termed herein as monomers A, B, and C, prepared, for example, by emulsion polymerization in the presence of an initiator, a chain transfer agent (CTA), and surfactant.

In embodiments, the resin substantially free of cross linking comprises styrene:butylacrylate:beta-carboxy ethyl acrylate wherein, for example, the non cross linked resin monomers are present in an amount of about 70% to about 90% styrene, about 10% to about 30% butylacrylate, and about 0.05 parts per hundred to about 10 parts per hundred beta-CEA, or about 3 parts per hundred beta-CEA, by weight based upon the total weight of the monomers, although not limited. For example, the carboxylic acid can be selected, for example, from the group comprised of, but not limited to, acrylic acid, methacrylic acid, itaconic acid, beta carboxy ethyl acrylate (beta CEA), fumaric acid, maleic acid, and cinnamic acid.

In a feature herein, the non cross linked resin comprises about 73% to about 85% styrene, about 27% to about 15% butylacrylate, and about 1.0 part per hundred to about 5 parts per hundred beta-CEA, by weight based upon the total weight of the monomers although the compositions and processes are not limited to these particular types of monomers or ranges. In another feature, the non cross linked resin comprises about 81.7% styrene, about 18.3% butylacrylate and about 3.0 parts per hundred beta-CEA by weight based upon the total weight of the monomers.

The initiator may be, for example, sodium, potassium or ammonium persulfate and may be present in the range of, for example, about 0.5 to about 3.0 percent based upon the weight of the monomers, although not limited. The CTA may be present in an amount of from about 0.5 to about 5.0 percent by weight based upon the combined weight of the monomers A and B, although not limited. In embodiments, the surfactant is an anionic surfactant present in the range of about 0.7 to about 5.0 percent by weight based upon the weight of the aqueous phase, although not limited to this type or range.

For example, the monomers are polymerized under starve fed conditions as referred to in Xerox patents such as U.S. Pat. Nos. 6,447,974, 6,576,389, 6,617,092, and 6,664,017, which are hereby incorporated by reference herein in their entireties, to provide latex resin particles having a diameter in the range of about 100 to about 300 nanometers.

For example, in embodiments the weight average molecular weight of the non cross linked latex resin can be from about 25,000 to about 60,000 such as from about 30,000 to about 37,000 or to about 45,000, such as about 34,000. In embodiments, the number average molecular weight (Mn) can be from about 5,000 to about 20,000, or about 11,000. However, molecular weights outside of these ranges can also be used.

In embodiments, the amount of carboxylic acid groups is selected in the range of about 0.04 to about 4.0 pph, such as about 0.1 to about 3 pph of the resin monomers A and B, although not limited.

In embodiments, the prepared non cross linked latex resin has a pH of about 1.0 to about 4.0, or about 2.0.

For example, a cross linked latex is prepared from a non cross linked latex comprising styrene, butylacrylate, beta-CEA, and divinyl benzene, termed herein as monomers A, B, C, and D, by emulsion polymerization, in the presence of an initiator such as a persulfate, a CTA, and a surfactant. In embodiments, the cross linked resin monomers are present in a ratio of about 60% to about 100% styrene, about 40% to about 0% butylacrylate, about 1 parts per hundred to about 5 parts per hundred beta-CEA, and about 0.5 parts per hundred to about 5 parts per hundred divinyl benzene, although not limited to these particular types of monomers or ranges.

In embodiments, the monomer composition may comprise, for example, about 65% styrene, 35% butylacrylate, 3 parts per hundred beta-CEA, and about 1 parts per hundred divinyl benzene, although the composition is not limited to these amounts.

In embodiments, the Tg (onset) of the cross linked latex is about 40° C. to about 100° C. or about 42° C.

In embodiments, the degree of cross linking is in the range of about 0.3 percent to about 20 percent, although not limited thereto, since an increase in the divinyl benzene concentration will increase the cross linking.

In embodiments, the soluble portion of the cross linked latex has a molecular weight (Mw) of about 120,000 to about 150,000, such as about 135,000, and a molecular number (Mn) of about 20,000 to about 35,000, such as about 27,000, but is not limited thereto.

In embodiments, the particle diameter size of the cross linked latex is about 20 to about 250 nanometers or about 50 nanometers, although not limited.

The surfactant may be any surfactant, such as for example a nonionic surfactant or an anionic surfactant, such as Neogen RK or Dowfax, both commercially available.

In embodiments, the pH is about 1.5 to about 3.0 or about 1.8.

In embodiments, the latex particle size can be, for example, from about 0.05 micron to about 10 microns, such as 0.1 to about 5 microns in average volume diameter as measured by the Brookhaven nanosize particle analyzer. Other sizes and effective amounts of latex particles may be selected in embodiments.

The latex resins selected for the present process are prepared, for example, by emulsion polymerization methods, and the monomers utilized in such processes can include the monomers listed above, such as, styrene, acrylates, methacrylates, butadiene, isoprene, acrylonitrile, acrylic acid, and methacrylic acid, and beta CEA. Known chain transfer agents, for example dodecanethiol, in effective amounts of, for example, from about 0.1 to about 10 percent, and/or carbon tetrabromide in effective amounts of from about 0.1 to about 10 percent, can also be employed to control the resin molecular weight during the polymerization.

Other processes of obtaining resin particles of from, for example, about 0.05 micron to about 1 micron can be selected from polymer microsuspension process, such as the processes disclosed in U.S. Pat. No. 3,674,736, the disclosure of which is totally incorporated herein by reference, polymer solution microsuspension processes, such as disclosed in U.S. Pat. No. 5,290,654, the disclosure of which is totally incorporated herein by reference, mechanical grinding processes, or other known processes.

In embodiments, the polyester resin includes any suitable polyester resin or mixture of polyester resins, such as crystalline polyester resins.

The crystalline resins, which are available from a number of sources, can be prepared by a polycondensation process by reacting an organic diol, and an organic diacid in the presence of a polycondensation catalyst. Generally, a stoichiometric equimolar ratio of organic diol and organic diacid is utilized, however, in some instances, wherein the boiling point of the organic diol is from about 180° C. to about 230° C., an excess amount of diol can be utilized and removed during the polycondensation process. The amount of catalyst utilized varies, and can be selected in an amount, for example, of from about 0.01 to about 1 mole percent of the resin. Additionally, in place of the organic diacid, an organic diester can also be selected, and where an alcohol byproduct is generated.

Examples of organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixture thereof, and the like. The aliphatic diol is, for example, selected in an amount of from about 45 to about 50 mole percent of the resin, and the alkali sulfo-aliphatic diol can be selected in an amount of from about 1 to about 10 mole percent of the resin.

Examples of organic diacids or diesters selected for the preparation of the crystalline polyester resins include oxalic acid, succinic acid, glutaric acid, adipic acid, suberic acid, azelaic acid, sebacic acid, phthalic acid, isophthalic acid, terephthalic acid, napthalene-2,6-dicarboxylic acid, naphthalene-2,7-dicarboxylic acid, cyclohexane dicarboxylic acid, malonic acid and mesaconic acid, a diester or anhydride thereof; and an alkali sulfo-organic diacid such as the sodio, lithio or potassium salt of dimethyl-5-sulfo-isophthalate, dialkyl-5-sulfo-isophthalate-4-sulfo-1,8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, 5-sulfo-isophthalic acid, dialkyl-sulfo-terephthalate, sulfoethanediol, 2-sulfopropanediol, 2-sulfobutanediol, 3-sulfopentanediol, 2-sulfohexanediol, 3-sulfo-2-methylpentanediol, 2-sulfo-3,3-dimethylpentanediol, sulfo-p-hydroxybenzoic acid, N,N-bis(2-hydroxyethyl)-2-amino ethane sulfonate, or mixtures thereof. The organic diacid is selected in an amount of, for example, from about 40 to about 50 mole percent of the resin, and the alkali sulfoaliphatic diacid can be selected in an amount of from about 1 to about 10 mole percent of the resin. There can be selected for the third latex branched amorphous resin an alkali sulfonated polyester resin. Examples of suitable alkali sulfonated polyester resins include, the metal or alkali salts of copoly(ethylene-terephthalate)-copoly-(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfo-isophthalate), copoly(propylene-butylene-terephthalate)-copoly(propylene-butylene-5-sulfo-isophthalate),copoly-(propoxylated bisphenol-A-fumarate)-copoly(propoxylated bisphenol-A-5-sulfo-isophthalate), copoly(ethoxylated bisphenol-A-fumarate)-copoly(ethoxylated bisphenol-A-5-sulfo-isophthalate), and copoly(ethoxylated bisphenol-A-maleate)-copoly(ethoxylated bisphenol-A-5-sulfo-isophthalate), and wherein the alkali metal is, for example, a sodium, lithium or potassium ion.

Examples of crystalline based polyester resins include alkali copoly(5-sulfo-isophthaloyl)-co-poly(ethylene-adipate), alkali copoly(5-sulfo-isophthaloyl)-copoly(propylene-adipate), alkali copoly(5-sulfo-isophthaloyl)-copoly(butylene-adipate), alkali copoly(5-sulfo-isophthaloyl)-copoly (pentylene-adipate), alkali copoly(5-sulfo-isophthaloyl)-copoly(octylene-adipate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-co-poly(butylene-adipate), alkali copoly(5-sulfo-isophthaloyl)-copoly(pentylene-adipate), alkali copoly(5-sulfo-isopthaloyl)-copoly(hexylene-adipate), alkali copoly(5-sulfo-isophthaloyl)-copoly(octylene-adipate), alkali copoly(5-sulfo-isophthaloyl)-copoly (ethylene-succinate), alkali copoly(5-sulfo-isophthaloyl-copoly(butylene-succinate), alkali copoly(5-sulfo-isophthaloyl)-copoly(hexylene-succinate), alkali copoly(5-sulfo-isophthaloyl)-copoly(octylene-succinate), alkali copoly(5-sulfo-isophthaloyl)-copoly(ethylene-sebacate), alkali copoly(5-sulfo-isophthaloyl)-copoly(propylene-sebacate), alkali copoly(5-sulfo-isophthaloyl)-copoly(butylene-sebacate), alkali copoly(5-sulfo-isophthaloyl)-copoly(pentylene-sebacate), alkali copoly(5-sulfo-isophthaloyl)-copoly (hexylene-sebacate), alkali copoly(5-sulfo-isophthaloyl)-copoly(octylene-sebacate), alkali copoly(5-sulfo-isophthaloyl)-copoly(ethylene-adipate), alkali copoly(5-sulfo-isophthaloyl)-copoly(propylene-adipate), alkali copoly(5-sulfo-iosphthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), poly(octylene-adipate); and wherein alkali is a metal of sodium, lithium or potassium, and the like. In embodiments, the alkali metal is lithium.

The polyester resin latex or emulsion can be prepared by any suitable means. For example, the latex or emulsion can be prepared by taking the resin and heating it to its melting temperature and dispersing the resin in an aqueous phase containing a surfactant. The dispersion can be carried out by various dispersing equipment such as ultimizer, high speed homogenizer, or the like to provide submicron resin particles. Other ways to prepare the polyester resin latex or emulsion include solubilizing the resin in a solvent and adding it to heated water to flash evaporate the solvent. External dispersion can also be employed to assist the formation of emulsion as the solvent is being evaporated. Polyester resin emulsions prepared by other means or methods can also be utilized in the preparation of the toner composition.

The polyester resin, such as crystalline polyester resin, can possess various melting points of, for example, from about 30° C. to about 120° C., or from about 35° C. to about 90° C. such as from about 40° C. to about 80° C. The polyester resin may have, for example, a number average molecular weight ($M_n$), as measured by gel permeation chromatography (GPC) of from about 1,000 to about 50,000, or from about 2,000 to about 25,000. The weight average molecular weight ($M_w$) of the crystalline polyester resin may be, for example, from about 2,000 to about 100,000, and from about 3,000 to about 80,000, as determined by gel permeation chromatography using polystyrene standards. The molecular weight distribution ($M_w/M_n$) of the crystalline polyester resin may be, for example, from about 2 to about 6, and more specifically, from about 2 to about 4.

The polyester resin particles in embodiments have an average particle diameter in the range of about 0.01 to about 10 microns, such as from about 0.1 to about 0.3 microns.

The polyester resin latex in embodiments is present in an amount of from about 5 to about 50 percent by weight of toner latex, such as from about 10 to about 30 percent or about 15% by weight of toner latex. However, amounts outside these ranges can be used.

For example, surfactants in amounts of, for example, about 0.01 to about 20, or about 0.1 to about 15 weight percent of the reaction mixture in embodiments include, for example, nonionic surfactants such as dialkylphenoxypoly(ethyleneoxy) ethanol, available from Rhone-Poulenc as IGEPAL CA-210™, IGEPAL CA-520™, IGEPAL CA-720™, IGEPAL CO-890™, IGEPAL CO-720™, IGEPAL CO-290™, IGEPAL CA-210.™, ANTAROX 890™ and ANTAROX 897.™ For example, an effective concentration of the nonionic surfactant is in embodiments, for example, about 0.01 percent to about 10 percent by weight, or about 0.1 percent to about 5 percent by weight of the reaction mixture.

Examples of anionic surfactants being, for example, sodium dodecylsulfate (SDS), sodium dodecylbenzene sulfonate, sodium dodecylnaphthalene sulfate, dialkyl benzenealkyl, sulfates and sulfonates, adipic acid, available from Aldrich, NEOGEN R.™, NEOGEN SC.™, available from Kao, Dowfax 2A1 (hexa decyldiphenyloxide disulfonate) and the like, among others. For example, an effective concentration of the anionic surfactant generally employed is, for example, about 0.01 percent to about 10 percent by weight, or about 0.1 percent to about 5 percent by weight of the reaction mixture Examples of bases used to increase the pH and hence ionize the aggregate particles thereby providing stability and preventing the aggregates from growing in size can be selected from sodium hydroxide, potassium hydroxide, ammonium hydroxide, cesium hydroxide and the like, among others.

Examples of additional surfactants, which may be added optionally to the aggregate suspension prior to or during the coalescence to, for example, prevent the aggregates from growing in size, or for stabilizing the aggregate size, with increasing temperature can be selected from anionic surfactants such as sodium dodecylbenzene sulfonate, sodium dodecylnaphthalene sulfate, dialkyl benzenealkyl, sulfates and sulfonates, adipic acid, available from Aldrich, NEOGEN R.™, NEOGEN SC™ available from Kao, and the like, among others. These surfactants can also be selected from nonionic surfactants such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol, available from Rhone-Poulenac as IGEPAL CA-210 ™, IGEPAL CA-520 ™, IGEPAL CA-72™, IGEPAL CO-890™, IGEPAL CO-720™, IGEPAL CO-290™, IGEPAL CA-210™, ANTAROX 890™ and ANTAROX 897™. For example, an effective amount of the anionic or nonionic surfactant generally employed as an aggregate size stabilization agent is, for example, about 0.01 percent to about 10 percent or about 0.1 percent to about 5 percent, by weight of the reaction mixture.

Examples of the acids that can be utilized include, for example, nitric acid, sulfuric acid, hydrochloric acid, acetic acid, citric acid, trifluro acetic acid, succinic acid, salicylic acid and the like, and which acids are in embodiments utilized in a diluted form in the range of about 0.5 to about 10 weight percent by weight of water or in the range of about 0.7 to about 5 weight percent by weight of water.

For example, wax suitable for the present toner compositions include alkylene waxes such as alkylene wax having for example about 1 to about 25 carbon atoms such as about 2 to about 20 or about 3 to about 12 carbon atoms, including polyethylene, polypropylene and the like, or mixtures thereof. The molecular weight (Mw) of the wax can be, for example, in the range of from about 300 or about 500 to about 5,000 or about 10,000, although values outside these ranges can be used. The wax is present, for example, in an amount of about 6% to about 15% by weight based upon the total weight of the composition. Examples of waxes include those as illustrated herein, such as those of the aforementioned co-pending applications, polypropylenes and polyethylenes commercially available from Allied Chemical and Petrolite Corporation, wax emulsions available from Michaelman Inc. and the Daniels Products Company, Epolene N-15™ commercially available from Eastman Chemical Products, Inc., Viscol 550-P™, a low weight average molecular weight polypropylene available from Sanyo Kasei K. K., and similar materials. The commercially available polyethylenes possess, it is believed, a molecular weight (Mw) of about 1,000 to about 5,000, and the commercially available polypropylenes are believed to possess a molecular weight of about 4,000 to about 10,000. Examples of functionalized waxes include amines, amides, for example Aqua Superslip 6550™, Superslip 6530™ available from Micro Powder Inc., fluorinated waxes, for example Polyfluo 190™, Polyfluo 200™, Polyfluo 523XF™, Aqua Polyfluo 411™, Aqua Polysilk 19™, Polysilk 14™ available from Micro Powder Inc., mixed fluorinated, amide waxes, for example Microspersion 19™ also available from Micro Powder Inc., imides, esters, quaternary amines, carboxylic acids or acrylic polymer emulsion, for example Joncryl 74™, 89™, 130™, 537™, and 538™, all available from SC Johnson Wax, chlorinated polypropylenes and polyethylenes available from Allied Chemical and Petrolite Corporation and SC Johnson Wax.

In embodiments, the wax comprises a wax in the form of a dispersion comprising, for example, a wax having a particle diameter of about 100 nanometers to about 500 nanometers, water, and an anionic surfactant. In embodiments, the wax is included in amounts such as about 6 to about 15 weight percent. In embodiments, the wax comprises polyethylene wax particles, such as Polywax 850, commercially available from Baker Petrolite, although not limited thereto, having a particle diameter in the range of about 100 to about 500 nanometers, although not limited. The surfactant used to disperse the wax is an anionic surfactant, although not limited thereto, such as, for example, Neogen RK™ commercially available from Kao Corporation or TAYCAPOWER BN2060 commercially available from Tayca Corporation.

For example, colorants or pigments as used herein include pigment, dye, mixtures of pigment and dye, mixtures of pigments, mixtures of dyes, and the like. For simplicity, the term "colorant" as used herein is meant to encompass such colorants, dyes, pigments, and mixtures, unless specified as a particular pigment or other colorant component. In embodiments, the colorant comprises a pigment, a dye, mixtures thereof, carbon black, magnetite, black, cyan, magenta, yellow, red, green, blue, brown, mixtures thereof, in an amount of about 1% to about 25% by weight based upon the total weight of the composition. It is to be understood that other useful colorants will become readily apparent based on the present disclosures.

In general, usefil colorants include Paliogen Violet 5100 and 5890 (BASF), Normandy Magenta RD-2400 (Paul Uhlrich), Permanent Violet VT2645 (Paul Uhlrich), Heliogen Green L8730 (BASF), Argyle Green XP-111-S (Paul Uhlrich), Brilliant Green Toner GR 0991 (Paul Uhlrich), Lithol Scarlet D3700 (BASF), Toluidine Red (Aldrich), Scarlet for Thermoplast NSD Red (Aldrich), Lithol Rubine Toner (Paul Uhlrich), Lithol Scarlet 4440, NBD 3700 (BASF), Bon Red C (Dominion Color), Royal Brilliant Red RD-8192 (Paul Uhlrich), Oracet Pink RF (Ciba Geigy), Paliogen Red 3340 and 3871K (BASF), Lithol Fast Scarlet L4300 (BASF), Heliogen Blue D6840, D7080, K7090, K6910 and L7020 (BASF), Sudan Blue OS (BASF), Neopen Blue FF4012 (BASF), PV Fast Blue B2G01 (American Hoechst), Irgalite Blue BCA (Ciba Geigy), Paliogen Blue 6470 (BASF), Sudan II, III and IV (Matheson, Coleman, Bell), Sudan Orange (Aldrich), Sudan Orange 220 (BASF), Paliogen Orange 3040 (BASF), Ortho Orange OR 2673 (Paul Uhlrich), Paliogen Yellow 152 and 1560 (BASF), Lithol Fast Yellow 0991K (BASF), Paliotol Yellow 1840 (BASF), Novaperm Yellow FGL (Hoechst), Permanerit Yellow YE 0305 (Paul Uhlrich), Lumogen Yellow D0790 (BASF), Suco-Gelb 1250 (BASF), Suco-Yellow D1355 (BASF), Suco Fast Yellow D1165, D1355 and D1351 (BASF), Hostaperm Pink E (Hoechst), Fanal Pink D4830 (BASF), Cinquasia Magenta (DuPont), Paliogen Black L9984 9BASF), Pigment Black K801 (BASF) and particularly carbon blacks such as REGAL 330 (Cabot), Carbon Black 5250 and 5750 (Columbian Chemicals), and the like or mixtures thereof Additional useful colorants include pigments in water based dispersions such as those commercially available from Sun Chemical, for example SUNSPERSE BHD 6011X (Blue 15 Type), SUNSPERSE BHD 9312X (Pigment Blue 15 74160), SUNSPERSE BHD 6000X (Pigment Blue 15:3 74160), SUNSPERSE GHD 9600X and GHD 6004X (Pigment Green 7 74260), SUNSPERSE QHD 6040X (Pigment Red 122 73915), SUNSPERSE RHD 9668X (Pigment Red 185 12516), SUNSPERSE RHD 9365X and 9504X (Pigment Red 57 15850:1, SUNSPERSE YHD 6005X (Pigment Yellow 83 21108), FLEXIVERSE YFD 4249 (Pigment Yellow 17 21105), SUNSPERSE YHD 6020X and 6045X (Pigment Yellow 74 11741), SUNSPERSE YHD 600X and 9604X (Pigment Yellow 14 21095), FLEXIVERSE LFD 4343 and LFD 9736 (Pigment Black 7 77226) and the like or mixtures thereof. Other useful water based colorant dispersions include those commercially available from Clariant, for example, HOSTAFINE Yellow GR, HOSTAFINE Black T and Black TS, HOSTAFINE Blue B2G, HOSTAFINE Rubine F6B and magenta dry pigment such as Toner Magenta 6BVP2213 and Toner Magenta E02 which can be dispersed in water and/or surfactant prior to use.

Other useful colorants include, for example, magnetites, such as Mobay magnetites M08029, M08960; Columbian magnetites, MAPICO BLACKS and surface treated magnetites; Pfizer magnetites CB4799, CB5300, CB5600, MCX6369; Bayer magnetites, BAYFERROX 8600, 8610; Northern Pigments magnetites, NP-604, NP-608; Magnox magnetites TMB-100 or TMB-104; and the like or mixtures thereof. Specific additional examples of pigments include phthalocyanine HELIOGEN BLUE L6900, D6840, D7080, D7020, PYLAM OIL BLUE, PYLAM OIL YELLOW, PIGMENT BLUE 1 available from Paul Uhlrich & Company, Inc., PIGMENT VIOLET 1, PIGMENT RED 48, LEMON CHROME YELLOW DCC 1026, E.D. TOLUIDINE RED and BON RED C available from Dominion Color Corporation, Ltd., Toronto, Ontario, NOVAPERM YELLOW FGL, HOSTAPERM PINK E from Hoechst, and CINQUASIA MAGENTA available from E.I. DuPont de Nemours & Company, and the like. Examples of magentas include, for example, 2,9-dimethyl substituted quinacridone and anthraquinone dye identified in the Color Index as CI 60710, CI Dispersed Red 15, diazo dye identified in the Color Index as CI 26050, CI Solvent Red 19, and the like or mixtures thereof. Illustrative examples of cyans include copper tetra (octadecyl sulfonamide) phthalocyanine, x-copper phthalocyanine pigment listed in the Color Index as C174160, CI Pigment Blue, and Anthrathrene Blue identified in the Color Index as DI 69810, Special Blue X-2137, and the like or mixtures thereof. Illustrative examples of yellows that may be selected include diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,4-dimethoxy acetoacetanilide, and Permanent Yellow FGL. Colored magnetites, such as mixtures of MAPICOBLACK and cyan components may also be selected as pigments.

In a featured embodiment, the coagulants used in the present process comprise poly metal halides, such as polyaluminum chloride (PAC) or polyaluminum sulfo silicate (PASS). For example, the coagulants provide a final toner having a metal content of, for example, about 400 to about 10,000 parts per million. In another feature, the coagulant comprises a poly aluminum chloride providing a final toner having an aluminum content of about 400 to about 10,000 parts per million For example, emulsion/aggregation/coalescing processes for the preparation of toners are illustrated in a number of Xerox patents, the disclosures of each of which are totally incorporated herein by reference, such as U.S. Pat. Nos. 5,290,654, 5,278,020, 5,308,734, 5,370,963, 5,344,738, 5,403,693, 5,418,108, 5,364,729, and 5,346,797. Also of interest are U.S. Pat. Nos. 5,348,832; 5,405,728; 5,366,841; 5,496,676; 5,527,658; 5,585,215; 5,650,255; 5,650,256; 5,501,935; 5,723,253; 5,744,520; 5,763,133; 5,766,818; 5,747,215; 5,827,633; 5,853,944; 5,804,349; 5,840,462; 5,869,215; 5,863,698; 5,902,710; 5,910,387; 5,916,725; 5,919,595; 5,925,488; and 5,977,210, the disclosures of each of which are hereby totally incorporated herein by reference. In addition, Xerox U.S. Pat. Nos. 6,627,373; 6,656,657; 6,617,092; 6,638,677; 6,576,389; 6,664,017; 6,656,658; and 6,673,505 are each hereby totally incorporated herein by reference. The appropriate components and process aspects of each of the foregoing U.S. Patents may be selected for the present composition and process in embodiments thereof.

In embodiments thereof, the toner process comprises forming a toner particle by mixing the non cross linked latex, the cross linked latex, and the polyester latex in the presence of a wax and a pigment dispersion to which is added a coagulant of a poly metal halide such as polyaluminum chloride while blending at high speeds such as with a polytron. The resulting mixture having a pH of, for example, about 2.0 to about 3.0 is aggregated by heating to a temperature below the resin Tg to provide toner size aggregates. Optionally, additional non cross linked latex is added to the formed aggregates providing a shell over the formed aggregates. The pH of the mixture is then changed, for example by the addition of a sodium hydroxide solution until a pH of about 7.0 is achieved. The temperature of the mixture is then raised to above the resin Tg, such as to about 95° C. After about 30 minutes, the pH of the mixture is reduced to a value sufficient to coalesce or fuse the aggregates to provide a composite particle upon further heating such as about 4.5. The fused particles are measured for shape factor or circularity, such as with a Sysmex FPIA 2100 analyzer, until the desired shape is achieved.

The mixture is allowed to cool to room temperature (about 20° C. to about 25° C.) and is optionally washed to remove the surfactant. The toner is then optionally dried.

While not wishing to be bound by theory, in the present toner composition comprising a non cross linked latex, a cross linked latex, a polyester latex, a wax, and a colorant, the polyester resin upon fusing plasticizes the toner particles resulting to provide a reduced MFT, such as below about 200° C. such as from about 130° C. to about 180° C., while the gel latex provides low gloss suitable for monochrome, particularly black, toner applications (such as a gloss value of 12 Gardner Gloss Units (ggu) or less). The ratio of the non cross linked latex to the cross linked latex, the content of polyester latex, the wax content and the colorant content can be selected to control the rheology of the toner.

In embodiments, the toner comprises non cross linked resin, cross linked resin or gel, polyester resin, wax, and colorant in an amount of about 30% to about 75% non cross linked resin, about 3% to about 13% cross linked resin or gel, about 5% to about 50% polyester resin, about 5% to about 15% wax, and about 5% to about 13% colorant, by weight based upon the total weight of the composition wherein a total of the components is about 100%, although not limited thereto. In embodiments, the non cross linked resin, the cross linked resin or gel, the wax, and the colorant are present in an amount of about 65% to about 70% non cross linked resin, about 5% to about 10% cross linked resin or gel, about 10% to about 20% polyester resin, about 9% wax, and about 10% colorant, by weight based upon the total weight of the composition.

In embodiments, the toner composition comprises a Mw in the range of about 25,000 to about 40,000 or about 35,000, a Mn in the range of about 9,000 to about 13,000 or about 10,000, and a Tg (onset) of about 45° C. or about 48° C. to about 65° C. or about 70° C., such as about 48° C. to about 62° C. or about 54° C. In embodiments, the toner composition has a minimum fixing temperature (MFT) that is as much as 20° C. or more below conventional toner compositions, such as having a MFT below about 200° C., such as from about 130° C. to about 180° C. In embodiments, the toner composition also has a low gloss, such as a gloss value of 12 Gardner Gloss Units (ggu) or less.

In embodiments of the present toner composition, the resultant toner possesses a shape factor of about 120 to about 140, and a particle circularity of about 0.930 to about 0.980.

In embodiments, the colorant comprises a black pigment such as carbon black. In yet another embodiment, the colorant is a pigment comprising black toner particles having a shape factor of about 120 to about 140 where a shape factor of 100 is considered to be spherical and a circularity of about 0.900 to about 0.980 as measured on an analyzer such as a Sysmex FPIA 2100 analyzer, where a circularity of 1.00 is considered to be spherical in shape.

In another feature, the colorant comprises a pigment dispersion, comprising pigment particles having a volume average diameter of about 50 to about 300 nanometers, water, and an anionic surfactant. For example, the colorant may comprise carbon black pigment dispersion such as with Regal 300 commercially available, prepared in an anionic surfactant and optionally a non-ionic dispersion to provide pigment particles having a size of from about 50 nanometers to about 300 nanometers. In embodiments, the surfactant used to disperse the carbon black is an anionic surfactant such as Neogen RK™, or TAYCAPOWDER BN 2060, although not limited thereto. For example, an ultimizer type equipment is used to provide the pigment dispersion, although media mill or other means can also be used.

Optionally, other various known colorants such as dyes or pigments may be present in the toner and the toner can optionally be used as an additional color in the xerographic engine besides black and is selected in an effective amount of, for example, from about 1 to about 65 percent by weight based upon the weight of the toner composition, in an amount of from about 1 to about 15 percent by weight based upon the weight of the toner composition, or in an amount of from about 3 to about 10 percent by weight, for example.

The toner particles can optionally be blended with external additives following formation. Any suitable surface additives may be used in embodiments. Suitable external additives include, for example, $SiO_2$, metal oxides such as $TiO_2$ and aluminum oxide, lubricating agent such as metal salts of fatty acids (such as zinc stearate or calcium stearate), long chain alcohols such as UNILIN® 700, and the like. In general, silica is applied to the toner surface for toner flow, tribo enhancement, admix control, improved development and transfer stability and higher toner blocking temperature. $TiO_2$ is applied for improved relative humidity (RH) stability, tribo control and improved development and transfer stability. Zinc stearate is applied to provide lubricating properties. Zinc stearate provides developer conductivity and tribo enhancement, both due to its lubricating nature. The external surface additives can be used with or without a coating.

In embodiments, the toners contain from, for example, about 0.1 to about 5 weight percent titania and/or other metal oxides, about 0.1 to about 8 weight percent silica, and about 0.1 to about 4 weight percent zinc stearate or other metal stearates.

The toner particles of the disclosure can optionally be formulated into a developer composition by mixing the toner particles with carrier particles. Illustrative examples of carrier particles that can be selected for mixing with the toner composition prepared in accordance with the present disclosure include those particles that are capable of triboelectrically obtaining a charge of opposite polarity to that of the toner particles. Accordingly, in one embodiment the carrier particles may be selected so as to be of a negative polarity in order that the toner particles that are positively charged will adhere to and surround the carrier particles. Illustrative examples of such carrier particles include iron, iron alloys, steel, nickel, iron ferrites, including ferrites that incorporate strontium, magnesium, manganese, copper, zinc, and the like, magnetites, and the like. Additionally, there can be selected as carrier particles nickel berry carriers as disclosed in U.S. Pat. No. 3,847,604, the entire disclosure of which is totally incorporated herein by reference, comprised of nodular carrier beads of nickel, characterized by surfaces of reoccurring recesses and protrusions thereby providing particles with a relatively large external area. Other carriers are disclosed in U.S. Pat. Nos. 4,937,166 and 4,935,326, the disclosures of which are totally incorporated herein by reference.

The selected carrier particles can be used with or without a coating, the coating generally being comprised of acrylic and methacrylic polymers, such as methyl methacrylate, acrylic and methacrylic copolymers with fluoropolymers or with monoalkyl or dialkylamines, fluoropolymers, polyolefins, polystyrenes, such as polyvinylidene fluoride resins, terpolymers of styrene, methyl methacrylate, and a silane, such as triethoxy silane, tetrafluoroethylenes, other known coatings and the like.

The carrier particles can be mixed with the toner particles in various suitable combinations. The toner concentration is usually about 2% to about 10% by weight of toner and about 90% to about 98% by weight of carrier. However, different toner and carrier percentages may be used to achieve a developer composition with desired characteristics.

Toners of the present disclosure can be used in electrostatographic (including electrophotographic) imaging methods. Thus for example, the toners or developers of the disclosure can be charged, such as triboelectrically, and applied to an oppositely charged latent image on an imaging member such as a photoreceptor or ionographic receiver. The resultant toner image can then be transferred, either directly or via an intermediate transport member, to a support such as paper or a transparency sheet. The toner image can then be fused to the support by application of heat and/or pressure, for example with a heated fuser roll.

It is envisioned that the toners of the present disclosure may be used in any suitable procedure for forming an image with a toner, including in applications other than xerographic applications.

An example is set forth hereinbelow and is illustrative of different compositions and conditions that can be utilized in practicing the disclosure. All proportions are by weight unless otherwise indicated. It will be apparent, however, that the disclosure can be practiced with many types of compositions and can have many different uses in accordance with the disclosure above and as pointed out hereinafter.

EXAMPLES

Preparation of Latex A:

A latex emulsion comprised of polymer particles generated from the emulsion polymerization of styrene, n-butyl acrylate and beta-CEA was prepared as follows. A surfactant solution consisting of 6.37 kilograms Dowfax 2A1 (anionic emulsifier) and 4096 kg de-ionized water was prepared by mixing for 10 minutes in a stainless steel holding tank. The holding tank was then purged with nitrogen for 5 minutes before transferring into the reactor. The reactor was then continuously purged with nitrogen while being stirred at 100 RPM. The reactor was then heated up to 80° C. at a controlled rate, and held there. Separately, 64.5 kg of ammonium persulfate initiator was dissolved in 359 kg of de-ionized water. Separately, the monomer emulsion was prepared in the following manner. 3516.6 kg of styrene, 787.7 kg of butyl acrylate and 129.1 kg of β-CEA, 30.1 kg of 1-dodecanethiol, 15.06 kg of ADOD (1,10-decanediol diacrylate), 85.1 kg of Dowfax 2A1 (anionic surfactant), and 2048 kg of deionized water were mixed to form an emulsion. 1% of the above emulsion is then slowly fed into the reactor containing the aqueous surfactant phase at 80° C. to form the "seeds" while being purged with nitrogen. The initiator solution is then slowly charged into the reactor and after 10 minutes the rest of the emulsion is continuously fed in a using metering pump at a rate of 0.5% /min. After 100 minutes, half of the monomer emulsion has been added to the reactor. At this time, 36.18 kilograms of 1-dodecanethiol is stirred into the monomer emulsion, and the emulsion is continuously fed in at a rate of 0.5%/min. Also at this time the reactor stirrer is increased to 350 RPM. Once all the monomer emulsion is charged into the main reactor, the temperature is held at 80° C. for an additional 2 hours to complete the reaction. Full cooling is then applied and the reactor temperature is reduced to 35° C. The product is collected into a holding tank. After drying the latex the molecular properties were Mw=33,700 Mn=10,900 and the onset Tg was 58.6° C.

Preparation of Latex B:

A latex emulsion comprised of polymer gel particles generated from the semi-continuous emulsion polymerization of styrene, n-butyl acrylate, divinylbenzene, and Beta-CEA was prepared as follows. A surfactant solution consisting of 1.75 kilograms Neogen RK (anionic emulsifier) and 145.8 kilograms de-ionized water was prepared by mixing for 10 minutes in a stainless steel holding tank. The holding tank was then purged with nitrogen for 5 minutes before transferring into the reactor. The reactor was then continuously purged with nitrogen while being stirred at 300 RPM. The reactor was then heated up to 76° C. at a controlled rate and held constant. In a separate container, 1.24 kilograms of ammonium persulfate initiator was dissolved in 13.12 kilograms of de-ionized water. Also in a second separate container, the monomer emulsion was prepared in the following manner. 47.39 kilograms of styrene, 25.52 kilograms of n-butyl acrylate, 2.19 kilograms of β-CEA, and 729 grams of 55% grade divinylbenzene, 4.08 kilograms of Neogen RK (anionic surfactant), and 78.73 kilograms of deionized water were mixed to form an emulsion. The ratio of styrene monomer to n-butyl acrylate monomer by weight was 65 to 35 percent. One percent of the above emulsion is then slowly fed into the reactor containing the aqueous surfactant phase at 76° C. to form the "seeds" while being purged with nitrogen. The initiator solution is then slowly charged into the reactor and after 20 minutes the rest of the emulsion is continuously fed in using metering pumps.

Once all the monomer emulsion is charged into the main reactor, the temperature is held at 76° C. for an additional 2 hours to complete the reaction. Full cooling is then applied and the reactor temperature is reduced to 35° C. The product is collected into a holding tank after filtration through a 1 micron filter bag. After drying a portion of the latex the molecular properties were measured to be Mw=134,700, Mn=27,300 and the onset Tg was 43.0° C. The average particle size of the latex as measured by Disc Centrifuge was 48 nanometers and residual monomer as measured by GC as <50 ppm for styrene and <100 ppm for n-butyl acrylate.

Preparation of Latex C:

A crystalline resin, copoly(hexylene-sebacate)-copoly (ethylene-5-sulfoisophthalate) sodium salt, was prepared from sodio-5-sulfoisophthalic acid, sebacic acid and hexanediol as follows.

A 1 liter Parr reactor equipped with a mechanical stirrer distillation apparatus and a bottom drain value was charged with 285 grams of sebacic acid, 166.5 grams of hexanediol, 3.7 grams of sodio 5-sulfo-isophthalic acid, and 0.4 gram of stannoic acid catalyst available as FASCAT™ from Elf-Atochem. The reactor was heated to 150° C. over a 1 hour period at an agitation rate of 100 rpm. The reaction temperature was then raised to 165° C. over a 1 hour period, during which the water byproduct started to collect in the distillation receiver. The reaction temperature was then increased to 185° C. over a 2 hour period, after which the pressure of the reaction was reduced to 0.1 mm-Hg over a 30 minute period. The reaction temperature was then raised to 200° C. for an additional 2 hours, and then the pressure was returned to atmospheric conditions, and the product discharged through the bottom drain valve. The crystalline resin copoly(hexylene-sebacate)-copoly(ethylene-5-sulfoisophthalate) sodium salt, and was found to display a melting point (by DSC) of about 64° C.

150 Grams of the above resin were then dissolved in 1 liter of acetone and the mixture resulting was added dropwise over a 5 hour period to a 4 liter kettle containing 2 liters of water at 80° C. The acetone solvent was removed by distillation to yield an emulsion with a resin particle size of 100 nanometers as measured on the Nicomp.

Preparation of Wax Dispersion:

An aqueous wax dispersion was generated using a wax available from Baker-Petrolite; P725 polyethylene wax with a low molecular weight Mw of 725, and a melting point of 104° C., and NEOGEN RK™ as an anionic surfactant/dispersant. The wax particle diameter size was determined to be approximately 200 nanometers, and the wax slurry was a solid loading of 30.30 percent (weight percent throughout).

Preparation of Colorant Dispersion:

A black pigment dispersion, obtained from Sun Chemicals, was an aqueous dispersion containing 17 percent carbon black (REGAL 330®), an anionic surfactant, 2 percent, and 81 percent water.

Example 1

Preparation of Toner Containing 15 Weight Percent Latex C 100.9 grams of latex A having a solids loading of 41.6 weight %, 55.82 grams of the wax emulsion, 68 grams of the black pigment dispersion having a solids loading of 16.6 weight %, 60 grams of latex B having a solids content of 25 weight %, and 114.8 grams of latex C having a solids loading of 19.6 weight % are added to 353 grams of deionized water in a vessel while being stirred using an IKA Ultra Turrax® T50 homogenizer operating at 4,000 rpm. After 5 minutes of homogenizing the solution at 4000 RPM is followed a drop-wise addition of 25.5 grams of a flocculent mixture containing 2.55 grams polyaluminum chloride mixture and 22.95 grams 0.02 molar nitric acid solution. As the flocculent mixture is added drop-wise, an additional 135 grams of deionized water is added to the mixture, and the homogenizer speed is increased to 5,200 rpm and homogenized for an additional 5 minutes. Thereafter, the mixture is heated at 1° C. per minute to a temperature of 42° C. and held there for a period of about 1.5 to about 2 hours resulting in a volume average particle diameter of 5.2 microns as measured with a Coulter Counter. During heat up period, the stirrer is run at about 250 rpm and 10 minutes after the set temperature of 42° C. is reached, the stirrer speed is reduced to about 220 rpm. Additional 101.0 grams of latex A is added to the reactor mixture and heated to a temperature of 55° C. and held there for an additional period of about 30 minutes resulting in a volume average particle diameter of about 5.8 microns. Adjusting the reactor mixture pH to 6 with 1.0 M sodium hydroxide solution freezes the particle size. Thereafter, the reactor mixture is heated at 1° C. per minute to a temperature of 93° C., followed by adjusting the reactor mixture pH to 4.0 with 0.3 M nitric acid solution. Following this, the reactor mixture is gently stirred at 93° C. for 2.5 hours to enable the particles to coalesce and spherodize. When the desired shape is achieved, as measured on a Sysmex FPIA shape analyzer, the pH is brought to pH 7.0. Following a full 2.5 hours at 93° C. the reactor heater is then turned off and the reactor mixture is allowed to cool to room temperature at a rate of 1° C./minute. The resulting toner mixture is comprised of about 16.7% toner, 0.25% anionic surfactant and about 82.9% by weight water. The toner of this mixture comprises about 56% styrene/acrylate polymer, about 8% Regal 0.330 pigment, about 11% by weight PW725 wax, about 10% by weight gel polymer, about 15% by weight CPE resin, and has a volume average particle diameter of about 5.9 microns and a GSD of about 1.27. The particles were washed 6 times, where the 1st wash was conducted at pH of 10 at 63° C., followed by 3 washes with deionized water at room temperature, one wash carried out at a pH of 4.0 at 40° C., and finally the last wash with deionized water at room temperature. FIG. 1 shows the DSC scan of the toner showing the sharp melting point of the CPE around 64° C., as well as the broad melting point of the PW725 wax at around 99.8° C.

Figure 2:
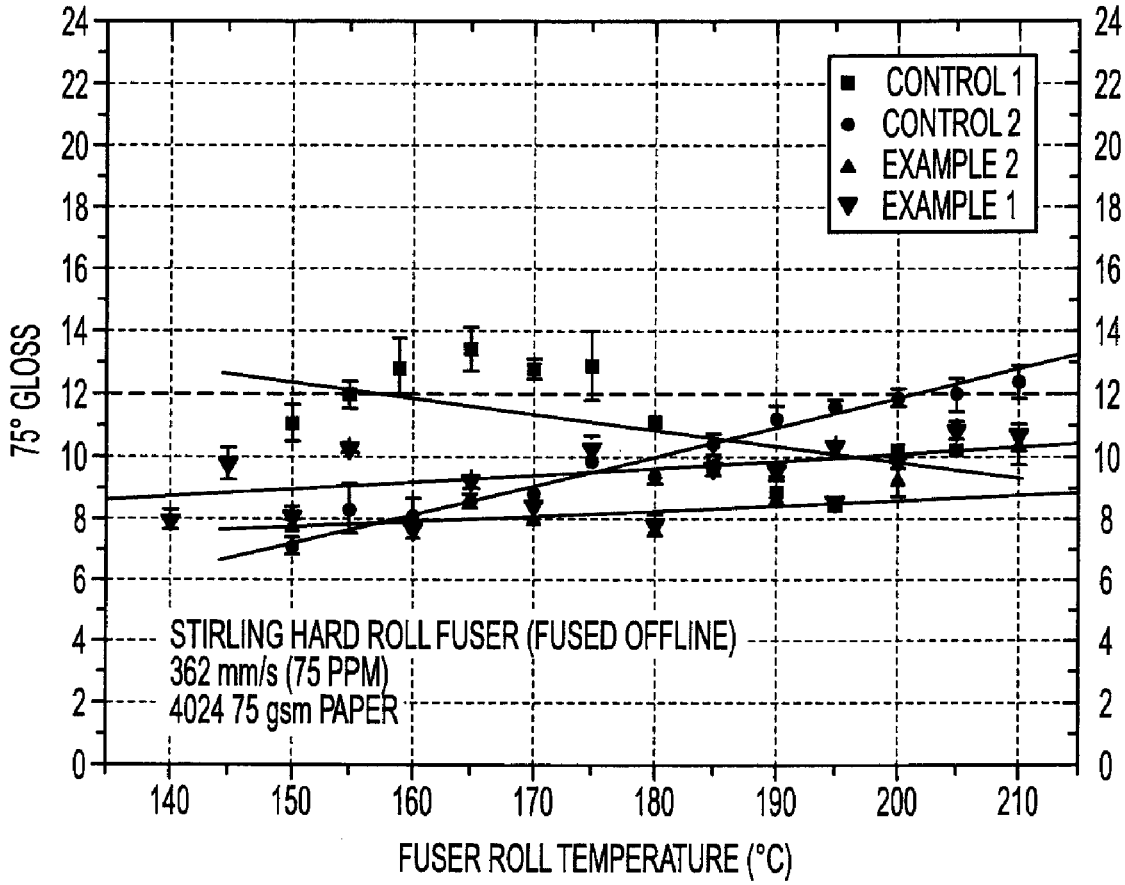
FIG. 2 shows the gloss versus fuser roll temperature of a toner according to an embodiment of this disclosure compared to two control toners.
Figure 3:
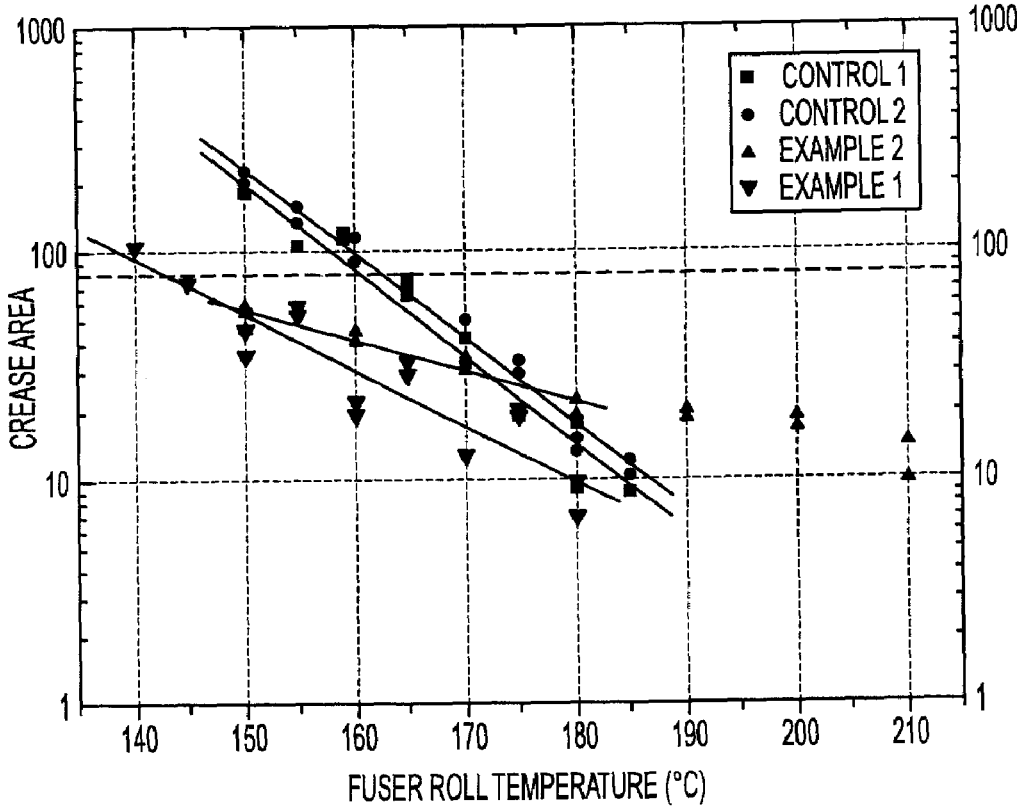
FIG. 3 shows crease versus fuser roll temperature of a toner according to an embodiment of this disclosure compared to two control toners.

Toner Evaluation:

Images were made using the above toner on Xerox 4024 75 gsm paper using a Mita copier, and then fused on a Stirling Hard Roll Fuser at a speed of 362 mm/second. For comparison, the toner composition of Example 1 is compared to two control toner compositions. Control 1 is a conventional toner used in mono machines. Control 2 is a chemical toner composed of 8% pigment, 10% gel and 11.5% PW725 wax, which is comparable to the toner of Example 1 except for the omission of the CPE (polyester) wax. FIGS. 2 and 3, discussed below, also include a fourth toner composition, designated Example 2, which is similar to the toner of Example 1 above, but includes 20% CPE (polyester) wax instead of the 15% CPE (polyester) wax of Example 1.

Gloss of the toner images as shown in FIG. 2 is well within the matte finish requirement for monochrome toner applications, i.e., where the gloss is not to exceed 12 ggu. The gloss for the toner composition stays well below this gloss for fusing temperatures from 140° C. to 210° C.

FIG. 3 shows the Crease Area of fused images using the toner composition as a function of temperature, which is a good indication as to the "low melt" behavior of the toner. FIG. 3 shows a dramatic improvement in crease area with the toner of Example 1 compared to the two control toners. The goal is to achieve a crease area of 80 or lower at the lowest temperature possible. The temperature to achieve a crease of 80 is called the minimum fixing temperature, or MFT. MFT for the toner of Example 1 is about −20° C. relative to the two control toners, which represents a drastic improvement.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A toner composition comprising:

a resin substantially free of cross linking that has a weight average molecular weight of from about 25,000 to about 60,000 and a number average molecular weight of from about 5,000 to about 20,000;

a cross linked resin that has a weight average molecular weight of from about 120,000 to about 150,000 and a number average molecular weight of from about 20,000 to about 35,000;

a polyester resin that has a weight average molecular weight of from about 2,000 to about 100,000 and a number average molecular weight of from about 1,000 to about 50,000;

a colorant; and a wax that has a weight average molecular weight (Mw) of from about 300 to about 10,000.

2. The toner composition of claim 1, wherein the resin substantially free of cross linking and the cross linked resin are both substantially free of polyester resin.

3. The toner composition of claim 1, wherein the polyester resin is a crystalline polyester.

4. The toner composition of claim 1, wherein the polyester resin is a crystalline sulfonated polyester.

5. The toner composition of claim 1, wherein the polyester resin is selected from the group consisting of alkali copoly (5-sulfoisophthaloyl)-co-poly(ethylene-adipate), alkali copoly(5-sulfoisophthaloyl)-copoly(propylene-adipate), alkali copoly(5-sulfoisophthaloyl)-copoly(butylene-adipate), alkali copoly(5-sulfo-isophthaloyl)-copoly(pentylene-adipate), alkali copoly(5-sulfo-iosphthaloyl)-copoly(octylene-adipate), alkali copoly(5-sulfo-isophthaloyl)-copoly (ethylene-adipate), alkali copoly(5-sulfo-isophthaloyl)-copoly(propylene-adipate), alkali copoly(5-sulfo-isophthaloyl)-co-poly(butylene-adipate), alkali copoly(5-sulfo-isophthaloyl)-copoly(pentylene-adipate), alkali copoly (5-sulfo-isophthaloyl)-copoly(hexylene-adipate), alkali copoly(5-sulfo-isophthaloyl)-copoly(octylene-adipate), alkali copoly(5-sulfoisophthaloyl)-copoly(ethylene-succinate), alkali copoly(5-sulfoisophthaloyl-copoly(butylene-succinate), alkali copoly(5-sulfoisophthaloyl)-copoly(hexylene-succinate), alkali copoly(5-sulfoisophthaloyl)-copoly (octylene-succinate), alkali copoly(5-sulfo-isophthaloyl)-copoly(ethylene-sebacate), alkali copoly(5-sulfo-isophthaloyl)-copoly(propylene-sebacate), alkali copoly(5-sulfo-isophthaloyl)-copoly(butylene-sebacate), alkali copoly (5-sulfo-isophthaloyl)-copoly(hexylene-sebacate), alkali copoly(5-sulfo-isophthaloyl)-copoly(hexylene-sebacate), alkali copoly(5-sulfo-isophthaloyl)-copoly(octylene-sebacate), alkali copoly(5-sulfo-isophthaloyl)-copoly(ethylene-adipate), alkali copoly(5-sulfo-isophthaloyl)-copoly(propylene-adipate), alkali copoly(5-sulfo-iosphthaloyl)-copoly (butylene-adipate), alkali copoly(5-sulfo-isophthaloyl)-copoly(pentylene-adipate), alkali copoly(5-sulfo-isophthaloyl) copoly(hexylene-adipate), and poly(octylene-adipate).

6. The toner composition of claim 1, wherein the polyester resin has a melting point of from about 40° C. to about 80° C.

7. The toner composition of claim 1, wherein the resin substantially free of cross linking has a degree of cross linking of about zero percent to about 0.1 percent, and the cross linked resin has a degree of cross linking of about 0.3 percent to about 30 percent.

8. The toner composition of claim 1, wherein the resin substantially free of cross linking and the cross linked resin are independently selected from the group consisting of styrene acrylates, styrene methacrylates, butadienes, isoprene, acrylonitrile, acrylic acid, methacrylic acid, beta-carboxy ethyl acrylate, polyesters, poly(styrene-butadiene), poly(methyl styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methyl styrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butyl acrylate-acrylic acid), poly(styrene-butyl acrylate-methacrylic acid), poly(styrene-butyl acrylate-acrylonitrile), poly(styrene-butyl acrylate-acrylonitrile-acrylic acid), and styrene/butyl acrylate/carboxylic acid terpolymers, and mixtures thereof.

9. The toner composition of claim 1, wherein the resin substantially free of cross linking and the cross linked resin each comprise styrene:butylacrylate:beta-carboxy ethyl acrylate.

10. The toner composition of claim 1, wherein the wax is an alkylene wax present in an amount of about 5% to about 15% by weight based upon the total weight of the composition.

11. The toner composition of claim 1, wherein the colorant comprises a pigment, a dye, or mixtures thereof, in an amount of about 1% to about 25% by weight based upon the total weight of the composition.

12. The toner composition of claim 1, wherein the colorant is a black colorant.

13. The toner composition of claim 1, comprising about 30% to about 75% resin substantially free of cross linking, about 3% to about 13% cross linked resin, about 5% to about 50% polyester resin, about 5% to about 15% wax, and about 5% to about 13% colorant, by weight based upon the total weight of the composition and wherein a total of the components is about 100%.

14. The toner composition of claim 1, comprising about 56% resin substantially free of cross linking, about 10% cross linked resin, about 15% polyester resin, about 11% wax, and about 8% colorant, by weight based upon the total weight of the composition and wherein a total of the components is about 100%.

15. The toner composition of claim 1, having a Tg of about 45° C. to about 70° C.

16. The toner composition of claim 1, having a minimum fixing temperature below about 200° C. and a gloss value of 12 Gardner Gloss Units or less.

17. The toner composition of claim 16, having a minimum fixing temperature from about 130° C. to about 180° C.

18. A developer comprising:

the toner of claim 1, and a carrier.

19. A toner process comprising:

mixing together;

a resin substantially free of cross linking, having a weight average molecular weight of from about 25,000 to about 60,000 and a number average molecular weight of from about 5,000 to about 20,000;

a cross linked resin that has a weight average molecular weight of from about 120,000 to about 150,000 and a number average molecular weight of from about 20,000 to about 35,000;

a polyester resin that has a weight average molecular weight of from about 2,000 to about 100,000 and a number average molecular weight of from about 1,000 to about 50,000;

a wax that has a weight average molecular weight (Mw) of from about 300 to about 10,000;

a colorant; and a coagulant to provide toner size aggregates;

adding additional resin substantially free of cross linking to the formed aggregates thereby providing a shell over the formed aggregates;

heating the aggregates to form toner;

cooling the mixture; and optionally, isolating the toner.

20. The toner process of claim 19, wherein the coagulant comprises a poly metal halide.

21. The toner process of claim 19, wherein the heating comprises a first heating below about the glass transition temperature of the resin substantially free of cross linking and a second heating above about the glass transition temperature of the resin substantially free of cross linking.

22. The toner process of claim 21, wherein the first heating is from about 45° C. to about 60° C. and the second heating is from about 80° C. to about 95° C.

23. The toner process of claim 19, further comprising:

providing an anionic surfactant in an amount of about 0.01% to about 20% by weight based upon a total weight of the reaction mixture;

wherein the anionic surfactant is selected from the group consisting of sodium dodecylsulfate, sodium dodecylbenzene sulfonate, sodium dodecylnaphthalene sulfate, dialkyl benzenealkyl, sulfates, sulfonates, adipic acid, hexa decyldiphenyloxide disulfonate, or mixtures thereof.

24. A method of developing an image, comprising:

applying the toner composition of claim 1 to an image; and fusing the toner composition to a substrate.

* * * * *